US006363229B1

(12) United States Patent
Shiraishi et al.

(10) Patent No.: US 6,363,229 B1
(45) Date of Patent: Mar. 26, 2002

(54) FULL-COLOR TONER IMAGE FIXING METHOD AND APPARATUS

(75) Inventors: Keiko Shiraishi; Masanori Suzuki; Yohichiroh Watanabe; Kazuhito Watanabe; Masahide Yamashita; Kohki Katoh; Masami Tomita; Yasuo Asahina; Yasuaki Iwamoto, all of Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/713,916

(22) Filed: Nov. 16, 2000

(30) Foreign Application Priority Data

Nov. 17, 1999 (JP) ..... 11-327545
Nov. 17, 1999 (JP) ..... 11-327546

(51) Int. Cl.[7] ..... G03G 15/20

(52) U.S. Cl. ..... 399/68; 219/216; 399/328; 399/329; 430/124

(58) Field of Search ..... 399/328, 329, 399/341, 67, 68, 320; 430/124; 219/216

(56) References Cited

U.S. PATENT DOCUMENTS 5,051,784 A * 9/1991 Yamamoto et al. ..... 399/329
6,040,103 A * 3/2000 Ohno et al. ..... 430/124 X
6,078,760 A * 6/2000 Abe et al. ..... 399/68 X
6,212,356 B1 * 4/2001 Ishikawa et al. ..... 399/329

OTHER PUBLICATIONS

U.S. Patent Application Ser. No. 09/384,797, Miyamoto et al., filed Aug. 27, 1999.

* cited by examiner

*Primary Examiner*—Sophia S. Chen
(74) *Attorney, Agent, or Firm*—Cooper & Dunham LLP

(57) ABSTRACT

A method for fixing full-color toner images on an image receiving member so that the fixed toner images selectively exhibit different glossinesses includes the step of bringing the transferred toner images into contact with a heater, with linear speeds being selectively switched in such a manner that the fixed toner images exhibit a mean surface roughness in a range of 9.5 to 16 $\mu$m at a linear speed (A), and the fixed toner images exhibit a mean surface roughness of less than 8 $\mu$m at a linear speed (B), wherein the linear speed (A) is in a range of 100 to 300 mm/sec, the linear speed (B) is lower than the linear speed (A) by 25 mm/sec or more, and the image fixing temperatures are equal at the linear speeds (A) and (B). A method for fixing full-color toner images with high glossiness on an image receiving member includes the step of bringing the transferred toner images into contact with a belt so that the fixed toner images exhibit a mean surface roughness of less than 8 $\mu$m.

18 Claims, 1 Drawing Sheet

FULL-COLOR TONER IMAGE FIXING METHOD AND APPARATUS

BACKGROUND OF THE INVENTION

1. Field of the Invention

The present invention relates to an image fixing method and apparatus for obtaining a full-color toner image by the electrophotographic process, or electrostatic image recording and printing method.

2. Discussion of Background

In the electrophotographic image formation process, a contact heating image fixing method is widely employed to fix a developed toner image on an image receiving sheet. Namely, the toner image transferred to a sheet is fixed thereon by bringing the toner into direct contact with a heater. In the contact heating image fixing method, it is desired to achieve satisfactory image fixing performance at low temperature and prevent the off-set phenomenon from occurring even at elevated temperature.

In recent years, the trend from monochromatic image formation to full-color image formation has been rapidly developing in the field of copiers and printers. A market for full-color copiers and printers has been expanding.

In the full-color image formation using color toners, when a plurality of color toners is superimposed, each of the color toners is sufficiently melted to be mixed together. High glossiness is also desired in the full-color image formation. For obtaining full-color toner images with high glossiness, it is proposed to decrease the image fixing speed, or increase the image fixing temperature as disclosed in Japanese Laid-Open Patent Applications 9-258592, 9-190107, 9-106210, 5-119651, 5-158364, 5-16026, 9-265243, 10-153923, 10-282822, and 11-24463.

In the image fixing method by contact heating, a fixing method by use of a heat-application roller is conventionally prevalent because of its simple structure and easy handling. However, there is the drawback that a certain time is always necessary until the heat-application roller reaches a predetermined image fixing temperature. In addition, there is a risk that the temperature of the heat-application roller varies when the image-bearing sheet passes therethrough, or according to other external factors. As a result, the image fixing properties become poor and the off-set phenomenon takes place. To maintain the heat-application roller at an optimum temperature, the heat capacity of the heat-application means such as a heat-application roller is required to increase.

The above-mentioned problem is serious especially in the fixing of full-color toner image. In general, a color image appears clearer when the glossiness of the color image becomes higher. To increase the glossiness of the fixed color toner image, the surface smoothness of the fixed image is increased by the application of a large pressure thereto. Therefore, the surface portion of a heat-application roller is required to have a relatively thick elastic member.

Furthermore, since a typical full-color toner has a low viscosity, the problems of off-set phenomenon and winding of the image-bearing sheet around the roller occur resulting from the curvature of the heat-application roller. To solve these problems, coating of a release oil over the surface of the heat-application roller is proposed. For this proposal, however, a tank for the release oil becomes necessary.

To solve the above-mentioned problems caused by the roller fixing method, a belt fixing method is proposed. Further, there are proposed image fixing methods using a belt with no oil being coated thereon, or a slight amount of oil being coated thereon. As disclosed in Japanese Laid-Open Patent Applications 2-160259 and 2-161462, the belt fixing methods are proposed in consideration of the combination of the belt fixing method and a toner composition suitable for the belt fixing.

However, the heat-application roller is usually used for fixing the full-color toner image because a high pressure can be applied to the full-color toner image. In contrast to this, the pressure applied to the full-color toner image by the belt is too low to obtain a full-color image with high glossiness. Namely, the belt fixing has no pressure-application effect on the formation of full-color toner images with high surface smoothness, that is, high glossiness in practice.

To obtain high glossiness under such conditions, the toner composition with a low melt viscosity is used. However, occurrence of the off-set phenomenon becomes more frequent. Further, the surface condition of the belt largely affects the surface smoothness of the fixed full-color toner image.

For obtaining high glossiness of full-color toner images by the belt fixing, Japanese Laid-open Patent Application 2-160250 proposes to diminish the irregularity of a toner-image-deposited surface on an image receiving sheet by controlling the volume mean diameter of toner particles, and contents of fine grains and coarse grains in the toner. However, in this case, a glossy full-color toner image cannot always be provided. In Japanese Laid-Open Patent Application 11-125948, the surface roughness of a toner image formed on an OHP sheet is specified. Even though the surface roughness of the toner image on the OHP sheet is specified, the off-set properties and the glossiness are not always satisfactory when the same toner image is formed on a sheet of plain paper since the surface conditions between an OHP sheet and a plain paper are different.

As mentioned above, full-color toner images have been required to have high glossiness. However, in some cases, too glossy full-color toner image may not be preferred, for example, as an image output from a printer. On the contrary, a full-color toner image having no glossiness may be desired. In other words, there is an increasing demand for variation in glossiness of the full-color toner image. To meet this demand, Japanese Laid-Open Patent Application 4-194967 proposes an image fixing mode capable of selectively switching the glossiness of the obtained full-color toner images, that is, selectively producing a highly glossy image or an image with no glossiness using the same image fixing apparatus. However, the conditions for producing highly glossy toner image are disadvantageous for prevention of the off-set phenomenon. Depending on the conditions, the off-set phenomenon cannot be effectively prevented. The off-set phenomenon may occur in a halftone image portion, which will be hereinafter referred to as "slight off-set phenomenon" although a solid image portion is not impaired by the off-set phenomenon. Furthermore, when the difference in the levels of glossiness is too large in the above-mentioned image fixing apparatus, there is the risk that each glossiness level becomes unstable.

SUMMARY OF THE INVENTION

It is therefore a first object of the present invention to provide a contact heating image fixing method for producing fixed full-color toner images which can selectively exhibit different glossinesses. Namely, a first object is to selectively produce a full-color toner image fixed with no glossiness or low glossiness, capable of exhibiting sufficient color development properties no matter whether the toner image is a single color image or mixed color image, and a full-color toner image fixed with a glossiness ranging from an intermediate level to a high level, capable of preventing the off-set phenomenon from occurring.

The first object of the present invention can be achieved by a method for fixing full-color toner images on an image receiving member so that the fixed toner images selectively exhibit different glossinesses, comprising the step of bringing the toner images transferred to the image receiving member into contact with a heater with linear speeds being selectively switched in such a manner that the fixed toner images exhibit a mean surface roughness in a range of 9.5 to 16 $\mu$m at a linear speed (A) at an image fixing temperature (T), and the fixed toner images exhibit a mean surface roughness of less than 8 $\mu$m at a linear speed (B) at an image fixing temperature (T'), wherein the linear speed (A) is in a range of 100 to 300 mm/sec, the linear speed (B) is lower than the linear speed (A) by 25 mm/sec or more, and the image fixing temperatures (T) and (T') are equal.

It is a second object of the present invention to provide an image fixing method for producing full-color toner images with color toners being fully mixed and fixed with high glossiness. To be more specific, the second object is to provide such full-color toner images fixed with high glossiness by use of an image fixing belt, without staining of the belt with toner resulting from the slight off-set phenomenon, and without the occurrence of the off-set phenomenon for an extended period of time, while a member for applying a slight amount of oil to the belt can be prevented from being contaminated with toner.

The second object of the present invention can be achieved by a method for fixing full-color toner images with high glossiness on an image receiving member, comprising the step of bringing the toner images transferred to the image receiving member into contact with an image fixing belt so that the fixed toner images exhibit a mean surface roughness of less than 8 $\mu$m.

A third object of the present invention is to provide a contact-heating type image fixing apparatus for producing fixed full-color toner images capable of selectively exhibiting different glossinesses.

The third object of the present invention can be achieved by an apparatus for fixing full-color toner images on an image receiving member so that the fixed toner images selectively exhibit different glossinesses, comprising a heater for heating the toner images transferred to the image receiving member in such a configuration that the heater is brought into contact with the toner images, with linear speeds being selectively switched in such a manner that the fixed toner images exhibit a mean surface roughness in a range of 9.5 to 16 $\mu$m at a linear speed (A) at an image fixing temperature (T), and the fixed toner images exhibit a mean surface roughness of less than 8 $\mu$m at a linear speed (B) at an image fixing temperature (T'), wherein the linear speed (A) is in a range of 100 to 300 mm/sec, the linear speed (B) is lower than the linear speed (A) by 25 mm/sec or more, and the image fixing temperatures (T) and (T') are equal.

A fourth object of the present invention is to provide a belt-type image fixing apparatus for producing full-color toner images with colortoners being fully mixed and fixed with high glossiness.

The fourth object of the present invention can be achieved by an apparatus for fixing full-color toner images with high glossiness on an image receiving member, comprising an image fixing belt for heating the toner images so that the fixed toner images exhibit a mean surface roughness of less than 8 $\mu$m by bringing the belt into contact with the toner images transferred to the image receiving member.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
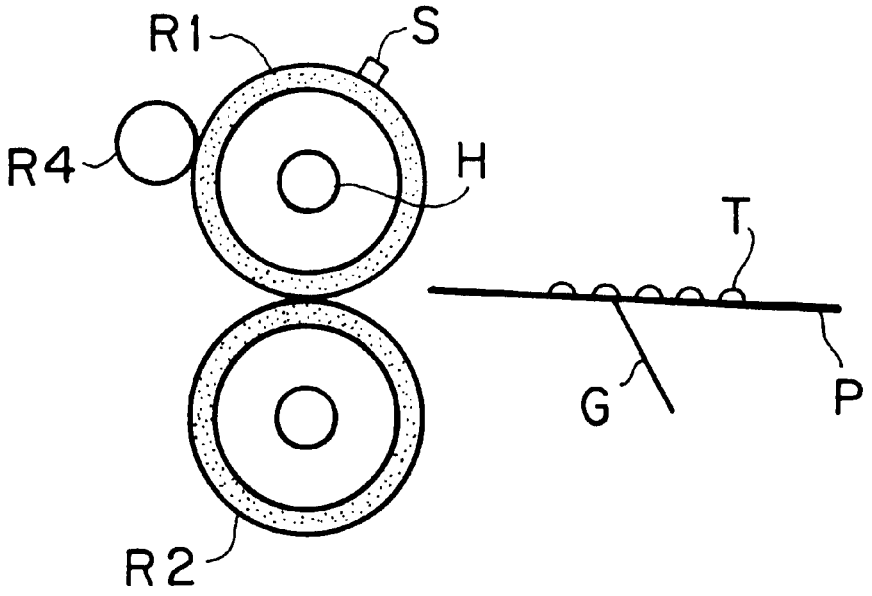
FIG. 1 is a schematic sectional view which shows one embodiment of the contact-heating type image fixing apparatus using a heat-application roller according to the present invention.

The glossiness of a full-color toner image fixed on an image receiving member is mainly determined by the surface smoothness of the fixed toner image. In the contact heating image fixing method, the glossiness of the fixed toner image increases with the increase in image fixing temperature. With respect to the linear speed of a toner-image bearing member passing through an image fixing member, the glossiness of the fixed toner image increases with the decrease in the linear speed of toner-image bearing member. Depending upon the elastic properties and release properties of the toner composition, the glossiness of the fixed toner image begins to decrease at a certain temperature or at a certain linear speed, although no off-set phenomenon is caused. The inventors of the present invention have discovered through observation of the surface conditions of the fixed full-color toner images that a fixed toner image exhibits a maximum surface smoothness immediately before the fixed toner image is ready to induce the off-set phenomenon. In view of the above, the present invention has been accomplished by specifying the mean surface roughness of the fixed toner images.

The mean surface roughness of the fixed images is measured in terms of the ten-point mean roughness (Rz) defined by Japanese Industrial Standards (JIS) B 0601.

As the temperature for image fixing increases, the color toners deposited on an image receiving member are melted together to such a degree that the interface between the color toners becomes obscure, and a mixed color image is thereafter fixed. At this stage, the surface smoothness of the fixed full-color toner image is not so high. By further elevating the imagefixing temperature to fuse the color toners, the fixed toner image shows high surface smoothness, and accordingly, high glossiness.

With the image fixing temperature further elevated, the cohesive strength among toner particles is weakened, so that the toner particles are transferred toward the surface of a roller or belt that is in contact with the toner image in the image fixing step. When the transferred toner returns to the surface of an image receiving sheet, the image receiving sheet is stained with toner. This phenomenon is called the off-set phenomenon as mentioned above. The occurrence of off-set lowers the surface smoothness of the fixed toner image.

When the toners on the image receiving member are about to transfer toward the roller or belt in the image fixing step just immediately before occurrence of the off-set phenomenon, the surface of the toner image slightly swells, thereby decreasing the surface smoothness. In such a case, there is a high possibility that the off-set phenomenon occurs in a halftone image portion although a solid image portion does not cause the off-set phenomenon. Such a phenomenon is hereinafter referred to as "slight off-set phenomenon."

The slight off-set phenomenon is similarly caused when the time for the toner-image bearing member to pass through the nip between the image fixing rollers is increased by decreasing the linear speed.

According to one embodiment of the present invention, in order to fix full-color toner images with no glossiness or low glossiness, the toner-image bearing sheet is caused to pass through an image fixing heating member at a linear speed (A) of 100 to 300 mm/sec so that the mean surface roughness (Rz) of the fixed full-color toner images is in the range of 9.5 to 16 $\mu$m. When the above-mentioned mean surface roughness exceeds 16 $\mu$m, the color toners are not thoroughly fused, resulting in insufficient fixing performance. Also, the color development performance may be unsatisfactory, with the interface between the color toners clearly remaining. In addition, when the mean surface roughness (Rz) of the fixed toner images is more than 16 $\mu$m, it becomes difficult to obtain sufficiently high surface roughness of the fixed full-color toner images when toner images with intermediate glossiness or high glossiness are desired. On the other hand, when the mean surface roughness is less than 9.5 $\mu$m in the above-mentioned case, the fixed images are not regarded as those with low glossiness.

To obtain full-color toner images with intermediate glossiness or high glossiness by the image fixing method of the present invention, the linear speed (B) is made slower than the linear speed (A) by 25 mm/sec or more so that the mean surface roughness (Rz) of the fixed images may be less than 8 $\mu$m. If the above-mentioned mean surface roughness exceeds 8 $\mu$m, desired highly glossy images cannot be obtained. In addition, even if a fixed toner image exhibits a maximum surface smoothness, the halftone image portions may be impaired by the slight off-set phenomenon although the solid image portions exhibit desired high glossiness. Further, even though the toner transferred to an image fixing member such as a roller or belt does not return to the image receiving member to prevent the occurrence of the off-set phenomenon, the surface of the roller or belt remains contaminated by toner. This will cause the image fixing member to deteriorate. In the case where an oil applicator comes in contact with the roller or belt, the toner transferred to the roller or belt is unfavorably deposited on the surface of the oil applicator. As a result, when the oil applicator is in the form of a pad, the toner stays on the pad. When the oil applicator is in the form of a roller having minute holes from which a small amount of oil can ooze out for the application of oil, the minute holes of the oil application roller are clogged with the toner. As mentioned above, although no off-set phenomenon occurs, the oil application performance is gradually lowered. When there is no oil applicator in the image fixing unit, the roller or belt itself will be degraded by the contamination of its surface portion.

In the solid image portion, there may occur slight transfer of toner from the solid image portion to the image fixing roller or belt, not a complete off-set phenomenon, In other words, a toner constituting the fixed image is dragged along the image fixing roller or belt. In this case, a considerably dragged portion is particularly protruded. Namely, such a protruding portion indicates a maximum height (Rmax) in the measurement of mean surface roughness, and the maximum height (Rmax) and the mean roughness (Rz) are greatly different in the above-mentioned case. To fix full-color toner images with high glossiness, it is preferable that the difference between the maximum height (Rmax) and the ten-point mean roughness (Rz) of the fixed toner images be 10 or less. When the above-mentioned difference exceeds 10, the same problems as caused by the slight off-set phenomenon may be produced.

A full-color toner image with extremely high surface smoothness and therefore high glossiness is not desired in certain circumstances. When the mean surface smoothness of the fixed toner images is remarkably high, the toner shows a low melt viscosity at the image fixing step. Therefore, the off-set phenomenon tends to easily occur depending upon a slight change in the image fixing conditions. In light of the above factor, to obtain fixed full-color toner images with intermediate glossiness or high glossiness, the mean surface roughness (Rz) of the fixed full-color toner images is preferably controlled to be 3 $\mu$m or more.

According to the first embodiment of the image fixing method of the present invention, the glossiness of the fixed toner image is mainly controlled by the image fixing linear speed. The image fixing linear speed (A) is set to 100 to 300 mm/sec to fix full-color toner images with no glossiness, or low glossiness. If the linear speed (A) exceeds 300 mm/sec, the thermal energy is not sufficient to fix the full-color toner images.

The image fixing linear speed (B) for fixing full-color toner images with intermediate glossiness or high glossiness is made lower than the above-mentioned linear speed (A). In consideration of the trend toward high speed printing, it is not desirable that the printing speed be too low. Therefore, the linear speed (A) is set to 100 mm/sec or more. Similarly, it is preferable that the linear speed (B) be 50 mm/sec or more.

In the present invention, the linear speed (B) to fix full-color toner images with intermediate or high glossiness is set lower than the linear speed (A) to fix full-color toner images with no glossiness, or low glossiness by 25 mm/sec or more. If the difference between the linear speeds (A) and (B) is less than 25 mm/sec, it is difficult to provide fixed full-color toner images with different glossinesses.

More preferably, the linear speed (B) is ⅓ to ⅔ the linear speed (A). When the linear speed (B) is determined with respect to the linear speed (A) in the above-mentioned way, full-color toner images with intermediate or high glossiness can be obtained without extreme decrease in printing speed. In addition, when the surface roughness (Rz) of the fixed full-color toner images is less than 8 $\mu$m at the linear speed (B) that is ⅓ to ⅔ the linear speed (A), there can be used any toner composition which shows little change in surface roughness depending on the linear speed. The surface roughness of a toner image made of such a toner composition does not largely vary depending upon other conditions. When the linear speeds are switched, the thermal energy given to the toner image is changed. However, the thermal energy given to the toner image is not always stabilized very soon immediately after the linear speed is changed because of the change in heat dissipation amount. Unfavorably, the image fixing conditions may become unstable. In such a case, however, it is possible to fix full-color toner images with desired glossiness in a relatively short time after the linear speed is changed by using the above-mentioned toner which shows little change in surface roughness depending on the linear speed. Consequently, the equal image quality can be outputted every time print is carried out at the same linear speed.

The fixing of toner images according to the present invention employs the contact heating method. In particular, when an image fixing belt is used, the thermal energy applied to the toner image by the image fixing belt can be stabilized in a relatively short time after the linear speeds are switched. The reason for this is that the heat capacity of the image fixing member can be decreased by using a belt as the image fixing member. Therefore, the image quality of the fixed toner images becomes more stable.

In the case where the image fixing belt is employed, the image fixing temperature at a linear speed (B) can be set higher than the image fixing temperature at a linear speed (A) by 10° C. or less. The thermal energy applied by the image fixing belt can be soon stabilized after the linear speeds are switched because of a small heat capacity of the image fixing belt, as mentioned above. Therefore, when the increase in image fixing temperature is 10° C. or less, much time is not needed to stabilize the thermal energy even after the image fixing temperature is changed. The mean surface roughness (Rz) of full-color toner images can be controlled to less than 8 $\mu$m by increasing the image fixing temperature by 10° C. or less even if it was impossible to obtain such a mean surface roughness at a linear speed (B) that is ⅓ the linear speed (A). In other words, a variety of toners suitable for the image fixing method according to the present invention can be extended. In this case, the linear speed (A) is in the range of 100 to 300 mm/sec, and the linear speed (B) is preferably ⅓ to ⅔ the linear speed (A).

According to another embodiment of the present invention, there is provided a method for fixing full-color toner images with high glossiness, comprising the step of bringing full-color toner image on an image receiving sheet into contact with a belt so that the full-color toner images exhibit a mean surface roughness (Rz) of less than 8 $\mu$m.

In the above-mentioned embodiment, the mean surface roughness (Rz) of the fixed toner images is measured when the toner images are fixed at a preset image fixing temperature depending upon the employed image fixing apparatus. Although it is possible to control the mean surface roughness (Rz) of the fixed toner images by increasing the image fixing temperature, a rise of image fixing temperature curtails the margin between the image fixing temperature and the off-set occurrence temperature.

In the present invention, the mean surface roughness of the fixed toner images is expressed by the ten-point mean roughness (Rz) and the maximum height (Rmax) defined in JIS B 0601. The mean surface roughness of a solid image portion is measured using a commercially available surface roughness meter, "Surfcom" made by a TOKYO SEIMITSU Co., Ltd., under the conditions that the reference length is 5 mm, and the measuring speed is 0.3 mm/sec. In the above, the term "solid image portion" is defined as an image portion having a toner deposition amount of 0.9 mg/cm$^2$ or more on an image receiving member before and after the image portion is subjected to the image fixing step. In practice, the ten-point mean roughness (Rz), of the fixed toner images is measured at solid image portions having a toner deposition amount of 1.0±0.1 mg/cm$^2$ on the image receiving member.

To obtain fixed toner images with a glossiness to a certain extent, the surface smoothness of an image fixing member such as a roller or belt largely affects the surface smoothness of the toner image. It is therefore preferable that the surface roughness (Rz) of the image fixing member that is brought into contact with the toner image in the image fixing step be 6 $\mu$m or less, more preferably 5 $\mu$m or less. When the surface roughness of the image fixing roller or belt is high, the roller or belt cannot apply uniform pressure to the toner image. At the point of a toner image where a strong pressure is applied by the image fixing member, the toner is excessively melted. On the other hand, at the point where a weak pressure is applied by the image fixing member, the toner cannot be melted sufficiently. The cohesive strength among toner particles is weak in the toner image at both points. The result is that the toner particles in contact with the image fixing member under the application of a strong pressure tend to easily separate and transfer to the surface of the image fixing member. Thus, the off-set phenomenon tends to readily occur.

For the same reasons, it is also recommended that the surface smoothness of the image receiving member to carry toner images thereon be high. The mean surface roughness (Rz) of the fixed toner images is defined in the present invention on the assumption that the toner images are fixed on an image receiving member with a mean surface roughness (Rz) of 35 $\mu$m or less. The mean surface roughness (Rz) of the image receiving member is preferably 30 $\mu$m or less.

The mean surface roughness of the image fixing member and that of the image receiving member are measured in the same manner as described above.

FIG. 1 is a schematic diagram which shows one embodiment of a contact heating image fixing method using a heat-application roller according to the present invention. An image fixing roller R1 is a heat-application roller, which is prepared by providing an elastic material on the surface of a metallic hollow cylinder, i.e., a pipe made of a metal such as aluminum, iron, copper, or stainless steel. A heating source (H) is built-in the metallic hollow cylinder.

An oil application roller R4 impregnated with an oil such as a silicone oil is disposed in contact with the image fixing roller R1 so that the oil can be applied to the surface of the image fixing roller R1. A temperature sensor (S) is attached to the outer surface of the image fixing roller R1 for detecting the surface temperature of the image fixing roller R1.

A pressure-application roller R2 comprises a metallic core made of a metal such as aluminum or iron, and an elastic material provided therearound. The image fixing roller R1 is urged by the pressure-application roller R2 to form a nip therebetween. A guide plate (G) supports an image receiving member (P) such as a sheet of plain paper which bears an unfixed toner image (T) thereon.

The contact heating image fixing apparatus provided with an image fixing roller is not limited to the embodiment of FIG. 1. For instance, an oil application member equipped with an oil tank may be disposed instead of the oil application roller R4, and another heating source may be set in the pressure-application roller R2.

Figure 2:
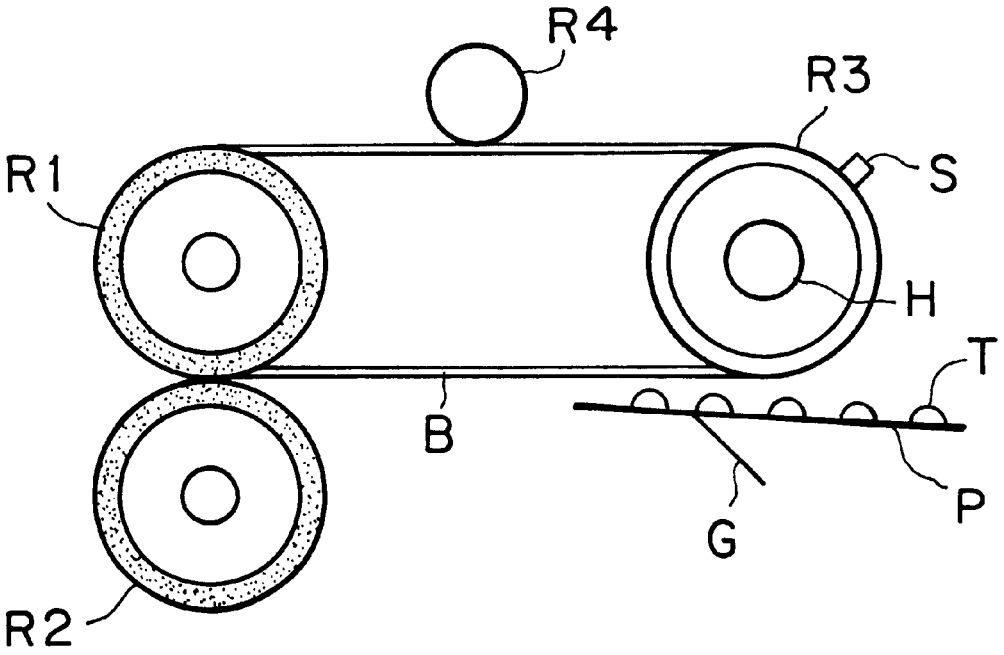
FIG. 2 is a schematic sectional view which shows another embodiment of the contact-heating type image fixing apparatus using an image fixing belt according to the present invention.

FIG. 2 is a schematic diagram which shows another embodiment of a contact heating image fixing method using an endless belt according to the present invention.

An image fixing roller R1 is prepared by providing an elastic material such as a silicone rubber around the surface of a metallic core made of a metal such as aluminum or iron. A heat-application roller R3 comprises a metallic hollow cylinder, i.e., a pipe made of a metal such as aluminum, iron, copper, or stainless steel. A heating source (H) is built-in the heat-application roller R3. An image fixing belt (B) is stretched in tension over the image fixing roller R1 and the heat-application roller R3. The image fixing belt (B) is constructed to exhibit a small heat capacity. To be more specific, the belt (B) is prepared by providing a release layer such as a silicone rubber layer with a thickness of about 50 to 300 μm, or a fluorine-containing resin layer with a thickness of about 10 to 50 μm on a support such as a nickel or polyimide sheet with a thickness of about 30 to 150 μm. A temperature sensor (S) is disposed in contact with the belt (B) for detecting the surface temperature of the image fixing belt (B) which is in contact with the heat-application roller R3. A pressure-application roller R2 is prepared by providing an elastic material around the surface of a metallic core. The image fixing roller R1 is urged by the pressure-application roller R2 via the image fixing belt (B) to form a nip between the belt (B) and the pressure-application roller R2. An oil application roller R4 impregnated with an oil such as a silicone oil is disposed in contact with the image fixing belt (B) so that the surface of the belt (B) is coated with the oil. A guide plate (G) supports an image receiving member (P) such as a sheet of plain paper which bears an unfixed toner image (T) thereon.

The contact heating image fixing apparatus provided with an image fixing belt is not limited to the above-mentioned embodiment of FIG. 2. For instance, the heating source may be incorporated in the image fixing roller R1 and the pressure-application roller R2.

Any image fixing apparatus provided with the image fixing roller or image fixing belt is applicable to the present invention. The dimensions of each member in the image fixing apparatus may be determined according to various conditions required.

When the image fixing apparatus is provided with no oil-application member (which is hereinafter referred to as an oil-free type image fixing apparatus) or with an oil-application member for supplying a slight amount of oil to the image fixing member, it is preferable to employ a toner composition which comprises a release agent finely dispersed in the toner composition. When the release agent is finely dispersed in the toner composition, the release agent easily oozes out at the image fixing step. Owing to such an action of the release agent, the transfer of toner to the image fixing belt can be effectively prevented in the oil-free type image fixing apparatus or the image fixing apparatus where the oil application performance of the oil-application member is impaired.

In order to maintain the release agent dispersed in the toner composition, it is not preferable that the release agent and the binder resin be compatible with each other. Further, the release agent can be finely dispersed in the toner composition in the course of kneading by the application of a shearing force.

The dispersed condition of the release agent can be confirmed by observation of a thin film section of toner by a transmission electron microscope (TEM). It is desirable that the diameter of the release agent particles dispersed in the toner composition be small. However, extremely small particles will hinder the release agent from oozing when the toner is fused at the image fixing step. In light of the above-mentioned factors, when the release agent can be identified in the toner composition by observation of the TEM under 10,000 times magnification, the release agent is considered to be appropriately dispersed in the toner composition. If the release agent cannot be identified by the TEM observation under 10,000 times magnification, there is a risk that the release agent cannot ooze when the toner composition is fused by the application of heat thereto even if the release agent is finely dispersed in the toner composition.

Any conventionally known materials can be used for the preparation of the toner composition for use in the present invention.

The toner for use in the present invention may comprise a binder resin, a coloring agent, and a release agent. Examples of the binder resin for use in the toner composition include homopolymers of styrene or substituted styrenes such as polystyrene, poly-p-chlorostyrene, and polyvinyltoluene; styrene-based copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinylmethyl ketone copolymer, styrene-butadiene copolymer, styrene-isoprene copolymer, styrene-acrylonitrile-indene copolymer, styrene-maleic acid copolymer, and styrene-maleate copolymer; and poly (methyl methacrylate), polytbutyl methacrylate), polylvinyl chloride), poly(vinyl acetate), polyethylene, polypropylene, polyester, epoxy resin, epoxy polyol resin, polyurethane, polyamide, poly(vinyl butyral), polyacrylic resin, rosin, modified rosin, and terpene resin. These binder resins, may be used alone or in combination.

Any conventional dyes and pigments can be used as the coloring agents for use in the toner.

Specific examples of the coloring agents for use in the present invention include carbon black, nigrosine dyes, iron black, Naphthol Yellow S, Hansa Yellow (10G, 5G, G), Cadmium Yellow, yellow iron oxide, Chinese Yellow, Chrome Yellow, Titanium Yellow, Polyazo Yellow, Oil Yellow, Hansa Yellow (GR, A, RN, R), Pigment Yellow L, Benzidine Yellow (G, GR), Permanent Yellow (NCG), Vulcan Fast Yellow (5G, R), Tartrazine Lake, Quinoline Yellow Lake, Anthrazane Yellow BGL, Isoindolinone Yellow, red iron oxide, red lead, Cadmium Red, Cadmium Mercury Red, antimony vermilion, Permanent Red 4R, Para Red, Parachlor o-nitroaniline Red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubin B, Brilliant Scarlet G, Lithol Rubin GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosine Lake, Rhodamine Lake B, Rhodamine Lake Y, Alizarine Lake, Thioindigo Red B. Thioindigo Maroon, Oil Red, Quinacridone Red, Pyrazolone Red, Polyazo Red, Chrome Vermilion, Benzidine Orange, Perinon Orange, Oil Orange, cobalt blue, cerulean blue, Alkali Blue Lake, Peacock Blue Lake, Victoria Blue Lake, Metal-free Phtalocyanine Blue, Phtalocyanine Blue, Fast Sky Blue, Indanthrene Blue (RS, BC), indigo, ultramarine, iron blue, Anthraquinone Blue, Fast Violet Red B, Methyl Violet Lake, cobalt violet, manganese violet, dioxane violet, Anthraquinone Violet, chrome green, zinc green, chromium oxide, viridian, emerald green, Pigment Green B, Naphthol Green B, green gold, Acid Green Lake, Malachite Green Lake, phthalocyanine green, anthraquinone green, titanium oxide, zinc white, lithopone, and mixtures thereof.

It is preferable that 0.1 to 50 parts by weight of coloring agent be used together with 100 parts by weight of the binder resin.

When the release agent is contained in the toner composition for use in the present invention, the following release agents can be used: natural waxes such as candelilla wax, carnauba wax, and rice wax; montan wax; paraffin wax; Sazol wax; low molecular weight polyethylene; low molecular weight polypropylene; and alkyl phosphate. Those release agents may be used alone or in combination.

The toner composition for use in the present invention may further comprise a charge control agent when necessary.

Specific examples of the charge control agent include metallic complex salts of monoazo dye, nitrohumic acid and salts thereof, quaternary ammonium salts, imidazole metallic complex compounds and salts thereof, salicylic acid, naphthoic acid salts, Co, Cr or Fe complex compounds of dicarboxylic acid, amino-containing compounds, an organic borate, Calixarene compounds, and organic dyes. A transparent or white charge control agent may be selected and added to a toner composition so as not to impair the color tone of the obtained color toner. Thus, the obtained toner can be provided with stable negative or positive polarity.

The amount of charge control agent depends upon the type of binder resin, presence or absence of additives, and the toner producing procedure including toner dispersing method, and is not unconditionally determined. Preferably, the charge control agent in an amount of 0.1 to 10 parts by weight, more preferably 2 to 5 parts by weight, may be added to 100 parts by weight of the binder resin. When the amount of charge control agent is less than 0.1 parts by weight, the charge quantity of toner is insufficient in practice. When the amount of charge control agent exceeds 10 parts by weight, the charge quantity of toner is excessively increased, so that the fluidity of a developer is lowered and the image density is decreased because of the increased electrostatic attraction to carrier particles.

The toner for use in the present invention may further comprise a magnetic material. Examples of the magnetic material include iron oxides such as ferrite, magnetite, and maghemite; metals such as iron, cobalt, and nickel; and alloys of these metals and other metals. Those magnetic materials may be used alone or in combination. It is also preferable to select a transparent or white magnetic material for keeping the color tone of the obtained color toner.

The toner for use in the present invention may further comprise conventionally known additives for imparting the fluidity or eliminating environmental dependency. Examples of such additives include finely-divided particles of inorganic materials such as zinc oxide, tin oxide, aluminum oxide, titanium oxide, silicon oxide, strontium titanate, barium titanate, calcium titanate, strontium zirconate, calcium zirconate, lanthanum titanate, calcium carbonate, magnesium carbonate, mica, and dolomite. Those materials may be used alone or in combination. Those particles may be treated to be hydrophobic.

In addition, finely-divided particles of fluoro-containing resins such as polytetrafluoroethylene, tetrafluoroethylene—hexafluoropropylene copolymer, and poly(vinylidene fluoride) may be used as a modifier for the surface properties of the toner particles.

Although the amount of the above-mentioned fluidity imparting agent or surface modifier depends upon the kind of agent, such an additive may be externally added in an amount of about 0.1 to 10 parts by weight to 100 parts by weight of the toner matrix particles. The finely-divided particles of the fluidity imparting agent and surface modifier may be mixed with toner matrix particles in a mixer when necessary so that the finely-divided particles of the above-mentioned agent may be externally added or attached to the surface of the toner particles. Alternatively, the above-mentioned agent may be used in such a fashion that the finely-divided particles of the agent are disposed in the free state between the toner particles.

The toner for use in the present invention can be prepared by sufficiently mixing and kneading the above-mentioned materials by the conventional method, using a two-roll mixer, a double screw extruder, or a single screw kneader. Thereafter, the kneaded mixture is pulverized by means of a mechanical pulverizer, and classified using jet air stream, thereby preparing toner matrix particles. The toner matrix particles can also be prepared by polymerization. The preparation method for the toner matrix particles is not limited to the above.

It is preferable that the volume mean diameter of the toner particles be in the range of 4 to 10 $\mu$m to provide high quality images. The volume mean diameter is measured by "Coulter Counter Model TA-II" (Trademark), made by Coulter Electronics Limited.

With the switching of the linear speeds taken into consideration, it is preferable that the toner for use in the present invention show a ½ flow-initiating point of 110 to 140° C. to provide sufficient fixing properties and color mixing properties. The above-mentioned ½ flow-initiating point of toner is the half point between the flow-initiating temperature and the flow-end temperature. To be more specific, a sample of toner (1 $cm^3$) is fused and extruded through the capillary die of a flow tester of capillary type "CTF-500" made by Shimadzu Corporation under the conditions that the diameter of the die orifice is 0.5 mm, the applied pressure is 10 $kg/cm^2$, and the heating rate is 3° C./min.

Further, the obtained toner matrix particles may be surface-treated by mixing with the aforementioned additives using a mixer.

In the present invention, full-color toner images may be produced by one-component development system using a toner alone, or two-component development system using a developer prepared by mixing a toner component and a carrier component.

When the two-component development is employed, any known carriers such as iron powder, ferrite, and glass beads can by used. These carrier particles may be coated with a resin. Examples of the resin used for coating of the carrier particles include polyfluorocarbon, poly(vinyl chloride), poly(vinylidene chloride), phenolic resin, poly(vinyl acetal), and silicone resin. With respect to the mixing ratio, it is proper that 0.5 to 60 parts by weight of the toner be mixed with 100 parts by weight of the carrier.

Other features of this invention will become apparent in the course of the following description of exemplary embodiments, which are given for illustration of the invention and are not intended to be limiting thereof.

EXAMPLES

Image fixing apparatus No. 1 to No. 5 were prepared.

[Image Fixing Apparatus No. 1]

The same image fixing apparatus as illustrated in FIG. 1 was produced except that the oil application roller R4 of FIG. 1 was replaced by an oil application pad equipped with an oil tank. Thus, an image fixing apparatus No. 1 was prepared. The image fixing temperature and the linear speed of the image fixing apparatus No. 1 were variable.

The detailed specifications are as follows:

<Image fixing roller R1>

Diameter of roller: 60 mm

Cylindrical core diameter: 56 mm (made of iron having a thickness of 2 mm)

Coating material; silicone rubber layer with a thickness of 2 mm, and a layer of tetrafluoroethylene (TFE)— perfluoroalkylvinyl ether (FVE) copolymer resin, which is hereinafter referred to as PFA, with a thickness of 30 μm on the silicone rubber layer.

Surface roughness (Rz); 4.5 μm

<Pressure-application roller R2>

Diameter of roller: 60 mm

Cylindrical core diameter: 58 mm (made of iron having a thickness of 1 mm)

Coating material: silicone rubber layer with a thickness of 1 mm, and PFA resin layer with a thickness of 30 μm on the silicone rubber layer.

Nip pressure between R1 and R2: 4.8 kgf/cm$^2$

Nip width for image fixing: 7 mm

<Oil application pad>

Applied amount of oil; 3 mg/A4 size

[Image Fixing Apparatus No. 2]

The same image fixing apparatus as illustrated in FIG 1 was produced. Thus, an image fixing apparatus No. 2 was prepared. The image fixing temperature and the linear speed of the image fixing apparatus No. 2 were variable.

The detailed specifications are as follows:

<Image fixing roller R1>

Diameter of roller: 60 mm

Cylindrical core diameter: 56 mm (made of iron having a thickness of 2 mm)

Coating material: silicone rubber layer with a thickness of 2 mm, and PFA resin layer with a thickness of 30 μm on the silicone rubber layer.

Surface roughness (Rz): 4.5 μm

<Pressure-application roller R2>

Diameter of roller: 60 mm

Cylindrical core diameter; 58 mm (made of iron having a thickness of 1 mm)

Coating material: silicone rubber layer with a thickness of 1 mm, and PFA resin layer with a thickness of 30 μm on the silicone rubber layer.

Nip pressure between R1 and R2: 4.8 kgf/cm$^2$

Nip width for image fixing: 7 mm

<Oil application roller R4>

Applied amount of oil: 1 mg/A4 size

[Image Fixing Apparatus No. 3]

The same image fixing apparatus as illustrated in FIG. 2 was produced. Thus, an image fixing apparatus No. 3 was prepared. The image fixing temperature and the linear speed of the image fixing apparatus No. 3 were variable.

The detailed specifications are as follows:

<Image fixing roller R1>

Diameter of roller: 38 mm, made of silicone foam (with Asker C hardness of about 30° in accordance with JIS K 6253)

<Pressure-application roller R2>

Diameter of roller: 50 mm

Cylindrical core diameter: 48 mm (made of iron having a thickness of 1 mm)

Coating material: silicone rubber layer with a thickness of 1 mm, and PFA resin layer with a thickness of 30 μm on the silicone rubber layer (with Asker C hardness of about 75° C. in accordance with JIS K 6253).

<Heat-application roller R3>

Cylindrical diameter; 30 mm (made of aluminum having a thickness of 2 mm)

<Image fixing belt B>

Belt diameter: 60 mm

Belt width: 310 mm

Material: nickel support with a thickness of about 40 μm, coated with a release layer with a thickness of about 150 μm made of a silicone rubber.

Surface roughness (Rz): 4.1 μm

Belt tension: 1.5 kg×2

Nip width for image fixing: 10 mm

Moving speed: 170 mm/sec

<Oil application roller R4>

Applied amount of oil: 1 mg/A4 size

[Image Fixing Apparatus No. 4]

The image fixing apparatus No. 3 was modified in the following points:

(1) The oil application roller R4 of the image fixing apparatus No. 3 was replaced by an oil application pad equipped with an oil tank capable of providing the surface of the belt with an oil in amount of 4 mg per A4-size area.

(2) The release layer of the image fixing belt B for use in the image fixing apparatus No. 3 was replaced by a fluorine-containing resin layer with a thickness of about 50 μm to have a surface roughness (Rz) of 6.0 μm.

Thus, an image fixing apparatus No. 4 was prepared.

[Image Fixing Apparatus No. 5]

The image fixing apparatus No. 3 was modified in such a manner that the amount of oil supplied by the oil application roller R4 was changed from 1 to 0.5 mg per A4-size area.

Thus, an image fixing apparatus No. 5 was prepared.

Thereafter, the following sets of color toners were prepared.

[Set of Color Toners A]

<Formulation for yellow toner>

| | Parts by Weight |
|---|---|
| Binder resin: polyester resin (½ flow-initiating point = 110° C.) | 100 |
| Coloring agent: disazo yellow pigment (C.I. Pigment Yellow 17) | 5 |
| Charge control agent: zinc salt of salicylic acid derivative | 2 |

<Formulation for magenta toner>

| | Parts by Weight |
|---|---|
| Binder resin: polyester resin (½ flow-initiating point = 110° C.) | 100 |
| Coloring agent: quinacridone magenta pigment (C.I. Pigment Red 122) | 4 |
| Charge control agent: zinc salt of salicylic acid derivative | 2 |

<Formulation for cyan toner>

| | Parts by Weight |
|---|---|
| Binder resin: polyester resin (½ flow-initiating point = 110° C.) | 100 |
| Coloring agent: copper phthalocyanine blue pigment (C.I. Pigment Blue 15) | 2 |
| Charge control agent: zinc salt of salicylic acid derivative | 2 |

<Formulation for black toner>

| | Parts by Weight |
|---|---|
| Binder resin: polyester resin (½ flow-initiating point = 110° C.) | 100 |
| Coloring agent: carbon black | 6 |
| Charge control agent: zinc salt of salicylic acid derivative | 2 |

Each of the color toner compositions was fully mixed using a blender, and fused and kneaded at 100 to 110° C. using a twin screw extruder. The kneaded mixture was cooled, coarsely crushed with a cutter mill, and finely pulverized with a pulverizer using a jet stream, and classified by a pneumatic classifier to provide toner matrix particles in each color having a volume mean diameter of 7±1 $\mu$m.

Then, 100 parts by weight of the toner matrix particles were mixed with 0.5 parts by weight of hydrophobic silica and 0.5 parts by weight of titanium oxide using a Henachel mixer, whereby yellow, magenta, cyan, and black color toners were obtained.

[Set of Color Toners B]

The procedure for preparation of the set of color toners A was repeated except that the formulations for yellow, magenta, cyan, and black toners were changed as follows:

<Formulation for yellow toner>

| | Parts by Weight |
|---|---|
| Binder resin: polyester resin (½ flow-initiating point = 110° C.) | 95 |
| Coloring agent: disazo yellow pigment (C.I. Pigment Yellow 17) | 5 |
| Charge control agent: zinc salt of salicylic acid derivative | 2 |
| Release agent: carnauba wax | 5 |

<Formulation for magenta toner>

| | Parts by Weight |
|---|---|
| Binder resin: polyester resin (½ flow-initiating point = 110° C.) | 95 |
| Coloring agent: quinacridone magenta pigment (C.I. Pigment Red 122) | 4 |
| Charge control agent: zinc salt of salicylic acid derivative | 2 |
| Release agent: carnauba wax | 5 |

<Formulation for cyan toner>

| | Parts by Weight |
|---|---|
| Binder resin: polyester resin (½ flow-initiating point = 110° C.) | 95 |
| Coloring agent: copper phthalocyanine blue pigment (C.I. Pigment Blue 15) | 2 |
| Charge control agent: zinc salt of salicylic acid derivative | 2 |
| Release agent: carnauba wax | 5 |

<Formulation for black toner>

| | Parts by Weight |
|---|---|
| Binder resin: polyester resin (½ flow-initiating point = 110° C.) | 95 |
| Coloring agent: carbon black | 6 |
| Charge control agent: zinc salt of salicylic acid derivative | 2 |
| Release agent: carnauba wax | 5 |

Thus, a set of color toners B was prepared.

[Set of Color Toners C]

The procedure for preparation of the set of color toners A was repeated except that the formulations for yellow, magenta, cyan, and black toners were changed as follows:

<Formulation for yellow toner>

| | Parts by Weight |
|---|---|
| Binder resin: polyester resin (½ flow-initiating point = 104° C.) | 68 |
| Binder resin: polyester resin (½ flow-initiating point = 131° C.) | 30 |
| Coloring agent: disazo yellow pigment (C.I. Pigment Yellow 17) | 5 |
| Charge control agent: zinc salt of salicylic acid derivative | 2 |
| Release agent: carnauba wax | 2 |

<Formulation for magenta toner>

| | Parts by Weight |
|---|---|
| Binder resin: polyester resin (½ flow-initiating point = 104° C.) | 68 |
| Binder resin: polyester resin (½ flow-initiating point = 131° C.) | 30 |
| Coloring agent: quinacridone magenta pigment (C.I. Pigment Red 122) | 4 |
| Charge control agent: zinc salt of salicylic acid derivative | 2 |
| Release agent: carnauba wax | 2 |

<Formulation for cyan toner>

| | Parts by Weight |
|---|---|
| Binder resin: polyester resin (½ flow-initiating point = 104° C.) | 68 |
| Binder resin: polyester resin (½ flow-initiating point = 131° C.) | 30 |
| Coloring agent: copper phthalocyanine blue pigment (C.I. Pigment Blue 15) | 2 |
| Charge control agent: zinc salt of salicylic acid derivative | 2 |
| Release agent: carnauba wax | 2 |

<Formulation for black toner>

| | Parts by Weight |
|---|---|
| Binder resin: polyester resin (½ flow-initiating point = 104° C.) | 68 |

-continued

| | Parts by Weight |
|---|---|
| Binder resin: polyester resin (½ flow-initiating point = 131° C.) | 30 |
| Coloring agent: carbon black | 6 |
| Charge control agent: zinc salt of salicylic acid derivative | 2 |
| Release agent: carnauba wax | 2 |

Thus, a set of color toners C was prepared.

[Set of Color Toners D]

The procedure for preparation of the set of color toners A was repeated except that the formulations for yellow, magenta, cyan, and black toners were changed as follows:

<Formulation for yellow toner>

| | Parts by Weight |
|---|---|
| Binder resin: polyol resin (½ flow-initiating point = 125° C.) | 87 |
| Binder resin: styrene - methyl acrylate copolymer resin (½ flow-initiating point = 125° C.) | 10 |
| Coloring agent: disazo yellow pigment (C.I. Pigment Yellow 17) | 5 |
| Charge control agent: zinc salt of salicylic acid derivative | 2 |
| Release agent: polyethylene wax | 3 |

<Formulation for magenta toner>

| | Parts by Weight |
|---|---|
| Binder resin: polyol resin (½ flow-initiating point = 125° C.) | 87 |
| Binder resin: styrene - methyl acrylate copolymer resin (½ flow-initiating point = 125° C.) | 10 |
| Coloring agent: quinacridone magenta pigment (C.I. Pigment Red 122) | 4 |
| Charge control agent: zinc salt of salicylic acid derivative | 2 |
| Release agent: polyethylene wax | 3 |

<Formulation for cyan toner>

| | Parts by Weight |
|---|---|
| Binder resin: polyol resin (½ flow-initiating point = 125° C.) | 87 |
| Binder resin: styrene - methyl acrylate copolymer resin (½ flow-initiating point = 125° C.) | 10 |
| Coloring agent: copper phthalocyanine blue pigment (C.I. Pigment Blue 15) | 2 |
| Charge control agent: zinc salt of salicylic acid derivative | 2 |
| Release agent: polyethylene wax | 3 |

<Formulation for black toner>

| | Parts by Weight |
|---|---|
| Binder resin: polyol resin (½ flow-initiating point = 125° C.) | 87 |
| Binder resin: styrene - methyl acrylate copolymer resin (½ flow-initiating point = 125° C.) | 10 |
| Coloring agent: carbon black | 6 |
| Charge control agent: zinc salt of salicylic acid derivative | 2 |
| Release agent: polyethylene wax | 3 |

Thus, a set of color toners D was prepared.

[Set of Color Toners E]

The procedure for preparation of the set of color toners A was repeated except that the formulations for yellow, magenta, cyan and black toners were changed as follows:

<Formulation for yellow toner>

| | Parts by Weight |
|---|---|
| Binder resin: polyester resin (½ flow-initiating point = 105° C.) | 97 |
| Coloring agent: disazo yellow pigment (C.I. Pigment Yellow 17) | 5 |
| Charge control agent: zinc salt of salicylic acid derivative | 2 |
| Release agent: polyethylene wax | 3 |

<Formulation for magenta toner>

| | Parts by Weight |
|---|---|
| Binder resin: polyester resin (½ flow-initiating point = 105° C.) | 97 |
| Coloring agent: quinacridone magenta pigment (C.I. Pigment Red 122) | 4 |
| Charge control agent: zinc salt of salicylic acid derivative | 2 |
| Release agent: polyethylene wax | 3 |

<Formulation for cyan toner>

| | Parts by Weight |
|---|---|
| Binder resin: polyester resin (½ flow-initiating point = 105° C.) | 97 |
| Coloring agent: copper phthalocyanine blue pigment (C.I. Pigment Blue 15) | 2 |
| Charge control agent: zinc salt of salicylic acid derivative | 2 |
| Release agent: polyethylene wax | 3 |

<Formulation for black toner>

| | Parts by Weight |
|---|---|
| Binder resin: polyester resin (½ flow-initiating point = 105° C.) | 97 |
| Coloring agent: carbon black | 6 |

-continued

| | Parts by Weight |
|---|---|
| Charge control agent: zinc salt of salicylic acid derivative | 2 |
| Release agent: polyethylene wax | 3 |

Thus, a set of color toners E was prepared.

[Set of Color Toners F]

The procedure for preparation of the set of color toners A was repeated except that the formulations for yellow, magenta, cyan, and black toners were changed as follows:

<Formulation for yellow toner>

| | Parts by weight |
|---|---|
| Binder resin: polyol resin (½ flow-initiating point = 114° C.) | 100 |
| Coloring agent: disazo yellow pigment (C.I. Pigment Yellow 17) | 5 |
| Charge control agent: zinc salt of salicylic acid derivative | 2 |

<Formulation for magenta toner>

| | Parts by weight |
|---|---|
| Binder resin: polyol resin (½ flow-initiating point = 114° C.) | 100 |
| Coloring agent: quinacridone magenta pigment (C.I. Pigment Red 122) | 4 |
| Charge control agent: zinc salt of salicylic acid derivative | 2 |

<Formulation for cyan toner>

| | Parts by weight |
|---|---|
| Binder resin: polyol resin (½ flow-initiating point = 114° C.) | 100 |
| Coloring agent: copper phthalocyanine blue pigment (C.I. Pigment Blue 15) | 2 |
| Charge control agent: zinc salt of salicylic acid derivative | 2 |

<Formulation for black toner>

| | Parts by weight |
|---|---|
| Binder resin: polyol resin (½ flow-initiating point = 114° C.) | 100 |
| Coloring agent: carbon black | 6 |
| Charge control agent: zinc salt of salicylic acid derivative | 2 |

Thus, a set of color toners F was prepared.

[Set of Color Toners G]

The procedure for preparation of the set of color toners A was repeated except that the formulations for yellow, magenta, cyan, and black toners were changed as follows:

<Formulation for yellow toner>

| | Parts by weight |
|---|---|
| Binder resin: styrene - methyl acrylate copolymer resin (½ flow-initiating point = 121° C.) | 100 |
| Coloring agent: disazo yellow pigment (C.I. Pigment Yellow 17) | 5 |
| Charge control agent: zinc salt of salicylic acid derivative | 2 |

<Formulation for magenta toner>

| | Parts by weight |
|---|---|
| Binder resin: styrene - methyl acrylate copolymer resin (½ flow-initiating point = 121° C.) | 100 |
| Coloring agent: quinacridone magenta pigment (C.I. Pigment Red 122) | 4 |
| Charge control agent: zinc salt of salicylic acid derivative | 2 |

<Formulation for cyan toner>

| | Parts by weight |
|---|---|
| Binder resin: styrene - methyl acrylate copolymer resin (½ flow-initiating point = 121° C.) | 100 |
| Coloring agent: copper phthalocyanine blue pigment (C.I. Pigment Blue 15) | 2 |
| Charge control agent: zinc salt of salicylic acid derivative | 2 |

<Formulation for black toner>

| | Parts by weight |
|---|---|
| Binder resin: styrene - methyl acrylate copolymer resin (½ flow-initiating point = 121° C.) | 100 |
| Coloring agent: carbon black | 6 |
| Charge control agent: zinc salt of salicylic acid derivative | 2 |

Thus, a set of color toners G was prepared.

[Set of Color Toners H]

The procedure for preparation of the set of color toners A was repeated except that the formulations for yellow, magenta, cyan, and black toners were changed as follows:

<Formulation for yellow toner>

| | Parts by Weight |
|---|---|
| Binder resin: polyester resin (1/2 flow-initiating point = 116° C.) | 97 |
| Coloring agent: disazo yellow pigment | 5 |

-continued

| | Parts by Weight |
|---|---|
| (C.I. Pigment Yellow 17) | |
| Charge control agent: zinc salt of salicylic acid derivative | 2 |
| Release agent: carnauba wax | 3 |

<Formulation for magenta toner>

| | Parts by Weight |
|---|---|
| Binder resin: polyester resin (1/2 flow-initiating point = 116° C.) | 97 |
| Coloring agent: quinacridone magenta pigment (C.I. Pigment Red 122) | 4 |
| Charge control agent: zinc salt of salicylic acid derivative | 2 |
| Release agent: carnauba wax | 3 |

<Formulation for cyan toner>

| | Parts by Weight |
|---|---|
| Binder resin: polyester resin (1/2 flow-initiating point = 116° C.) | 97 |
| Coloring agent: copper phthalocyanine blue pigment (C.I. Pigment Blue 15) | 2 |
| Charge control agent: zinc salt of salicylic acid derivative | 2 |
| Release agent: carnauba wax | 3 |

<Formulation for black toner>

| | Parts by Weight |
|---|---|
| Binder resin: polyester resin (½ flow-initiating point = 116° C.) | 97 |
| Coloring agent: carbon black | 6 |
| Charge control agent: zinc salt of salicylic acid derivative | 2 |
| Release agent: carnauba wax | 3 |

Thus, a set of color toners H was prepared.

[Set of Color Toners I]

The procedure for preparation.of the set of color toners A was repeated except that the formulations for yellow, magenta, cyan, and black toners were changed as follows:

<Formulation for yellow toner>

| | Parts by Weight |
|---|---|
| Binder resin: polyester resin (½ flow-initiating point = 104° C.) | 100 |
| Coloring agent: disazo yellow pigment (C.I. Pigment Yellow 17) | 5 |
| Charge control agent: zinc salt of salicylic acid derivative | 2 |

<Formulation for magenta toner>

| | Parts by Weight |
|---|---|
| Binder resin: polyester resin (½ flow-initiating point = 104° C.) | 100 |
| Coloring agent: quinacridone magenta pigment (C.I. Pigment Red 122) | 4 |
| Charge control agent: zinc salt of salicylic acid derivative | 2 |

<Formulation for cyan toner>

| | Parts by Weight |
|---|---|
| Binder resin: polyester resin (½ flow-initiating point = 104° C.) | 100 |
| Coloring agent: copper phthalocyanine blue pigment (C.I. Pigment Blue 15) | 2 |
| Charge control agent: zinc salt of salicylic acid derivative | 2 |

<Formulation for black toner>

| | Parts by Weight |
|---|---|
| Binder resin: polyester resin (½ flow-initiating point = 104° C.) | 100 |
| Coloring agent: carbon black | 6 |
| Charge control agent: zinc salt of salicylic acid derivative | 2 |

Thus, a set of color toners I was prepared.

[Set of Color Toners J]

The procedure for preparation of the set of color toners A was repeated except that the formulations for yellow, magenta, cyan, and black toners were changed as follows:

<Formulation for yellow toner>

| | Parts by Weight |
|---|---|
| Binder resin: polyester resin (½ flow-initiating point = 135° C.) | 100 |
| Coloring agent: disazo yellow pigment (C.I. Pigment Yellow 17) | 5 |
| Charge control agent: zinc salt of salicylic acid derivative | 2 |

<Formulation for magenta toner>

| | Parts by Weight |
|---|---|
| Binder resin: polyester resin (½ flow-initiating point = 135° C.) | 100 |
| Coloring agent: quinacridone magenta pigment (C.I. Pigment Red 122) | 4 |
| Charge control agent: zinc salt of salicylic acid derivative | 2 |

<Formulation for cyan toner>

| | Parts by Weight |
|---|---|
| Binder resin: polyester resin (1/2 flow-initiating point = 135° C.) | 100 |
| Coloring agent: copper phthalocyanine blue pigment (C.I. Pigment Blue 15) | 2 |
| Charge control agent: zinc salt of salicylic acid derivative | 2 |

<Formulation for black toner>

| | Parts by Weight |
|---|---|
| Binder resin: polyester resin (1/2 flow-initiating point = 135° C.) | 100 |
| Coloring agent: carbon black | 6 |
| Charge control agent: zinc salt of salicylic acid derivative | 2 |

Thus, a set of color toners J was prepared.

With respect to the toner compositions B to E, and H, it was confirmed that the release agent was dispersed in each toner composition by the TEM observation of a thin film section of toner composition.

Using the image fixing apparatus and the set of color toners selected from the above in each Example, an image formation test was carried out, and the evaluations were made in the following manner.

[Image Formation Test]

5 parts by weight of each color toner particles were mixed with 100 parts by weight of carrier particles prepared by coating ferrite core particles with an average particle size of 50 $\mu$m with a silicone resin in a mixer. Thus, two-component yellow, magenta, cyan, and black developers were prepared.

The two-component color developers were incorporated in a developer unit of a commercially available copying machine "PRETER 550" (Trademark), made by Ricoh Company, Ltd. The copying machine was modified so that the original image fixing apparatus was replaced by any image fixing apparatus as mentioned above. As the image receiving sheet, there was employed "type 6000-70W" with a surface roughness (Rz) of 29.9 $\mu$m, made by Ricoh Company, Ltd.

There were produced on the image receiving sheet a solid image and a halftone image, each consisting of a single color, that is, yellow, magenta, cyan, or black color, and a solid image of green, blue, or red color constituted by mixture of color toners. The copying machine was adjusted to produce a solid image of a single color with a toner deposition amount of 1.0±0.1 mg/cm$^2$, and a halftone image of a single color with a toner deposition amount of 0.4±0.1 mg/cm$^2$.

The image fixing was carried out in the following manner in Examples 1 to 4, Reference Example 1, and Comparative Examples 1 to 3. The images were continuously printed on 5 sheets of paper at the linear speed (A). The linear speed (A) was changed to the linear speed (B). 10 seconds later, the images were continuously printed on 5 sheet of paper. The linear speed (B) was returned to the linear speed (A). After 10 seconds the images were continuously printed on 5 sheet of paper at the linear speed (A). Finally, the linear speed (A) was changed to the linear speed (B) once more. 10 seconds later, the images were continuously printed on 5 sheet of paper at the linear speed (B). Namely, the images were separately printed on 10 sheets of paper at the linear speed (A) and the linear speed (B) in total.

[Measurement of Surface Roughness]

The surface roughness (Rz) and the glossiness of the solid image portion formed by a single color were measured at three points on the same sheet, and the average value was obtained for each sheet of paper. The glossiness was measured by a gloss meter made by Nippon Denshoku Kogyo Co., Ltd. at an incident angle of 60°. The results are shown in TABLE 1.

[Evaluation of Image Fixing Properties]

The solid image portion fixed at the linear speed (A) was rubbed with an erasing material containing abrasives. The image fixing properties were evaluated by inspecting whether the image density of the fixed solid image was changed or not. The results are shown in TABLE 1.

[Presence or Absence of Off-set Phenomenon]

The presence or absence of the off-set phenomenon was judged by visually observing the images fixed at the linear speed (B).

Further, the same images were again formed and fixed at the linear speed (B) at an image fixing temperature higher than the preset temperature by 5° C., and the occurrence of the off-set phenomenon was observed.

Thereafter, the image fixing temperature was returned to the preset temperature, and 10,000 copies were continuously made. After completion of continuous copying operation, the fixed images were observed with respect to the occurrence of off-set phenomenon. Further, the image fixing apparatus was disassembled to observe whether the image fixing roller, belt, or oil application member was stained with toner deposition. The results are shown in TABLE 1.

Example 1

The image fixing apparatus No. 1 and the set of color toners A were incorporated in the copying machine.

The above-mentioned image formation test was carried out at an image fixing temperature of 150° C. The linear speed (A) was set at 125 mm/sec and the linear speed (B) was set at 95 mm/sec.

When the linear speed (A) was employed, the mean surface roughness (Rz) of the solid single color images fixed on every sheet was within the range of 9.5 to 12.7 $\mu$m. In this case, the solid single color images stably exhibited low glossiness in the range of 12 to 16 although the surface roughness (Rz) of the toner images fixed on the first two sheets gave small values in the second image formation at the linear speed (A). The image fixing properties were also excellent, and the color development properties of both the single color image and the mixed color image were all satisfactory.

When the linear speed (B) was employed, the mean surface roughness (Rz) of the solid single color images fixed on every sheet was within the range of 4.2 to 6.3 $\mu$m. In this case, the solid single color images stably exhibited high glossiness in the range of 30 to 33 although the mean surface roughness (Rz) of the toner images fixed on the first sheet and the second sheet gave comparatively great value and small value respectively after the linear speed (A) was changed to the linear speed (B).

The occurrence of the off-set phenomenon was not observed, and the color development properties of both the single color image and the mixed color image were all satisfactory.

Even when the image fixing temperature was increased by 55° C. in the mode of the linear speed (B), there occurred no off-set phenomenon. Namely, it was found that a good margin was left with respect to the occurrence of off-set phenomenon even when toner images were fixed at 150° C. at the linear speed (B).

The image fixing temperature was returned to 150° C. to make 10,000 copies. After making of 10,000 copies, no off-set phenomenon occurred, and there were produced the same clear images with high glossiness as obtained before the continuous copying operation.

Then, the image fixing apparatus No. 1 was disassembled to observe the surface of the image fixing roller and the oil application pad. There was no toner deposition.

Example 2

The image fixing apparatus No. 2 and the set of color toners B were incorporated in the copying machine.

The above-mentioned image formation test was carried out at an image fixing temperature of 155° C. The linear speed (A) was set at 140 mm/sec and the linear speed (B) was set at 100 mm/sec.

When the linear speed (A) was employed, the mean surface roughness (Rz) of the solid single color images fixed on every sheet was within the range of 9.5 to 11.9 μm. In this case, the solid single color images stably exhibited low glossiness in the range of 8 to 12 although there was slight dispersion in the surface roughness (Rz). The image fixing properties were also excellent, and the color development properties of both the single color image and the mixed color image were all satisfactory.

When the linear speed (B) was employed, the mean surface roughness (Rz) of the solid single color images fixed on every sheet was within the range of 4.1 to 5.5 μm. In this case, the solid single color images stably exhibited high glossiness in the range of 39 to 44 although there was slight dispersion in the mean surface roughness (Rz)

The occurrence of the off-set phenomenon was not observed, and the color development properties of both the single color image and the mixed color image were all satisfactory.

Even when the image fixing temperature was increased by 5° C. in the mode of the linear speed (B), there occurred no off-set phenomenon. Namely, it was found that a good margin was left with respect to the occurrence of off-set phenomenon even when toner images were fixed at 155° C. at the linear speed (B).

Although the amount of oil applied to the surface of the image fixing roller was smaller than in Example 1, the release agent dispersed in the toner composition had an effect on the prevention of the off-set phenomenon.

The image fixing temperature was returned to 155° C. to make 10,000 copies. After making of 10,000 copies, no off-set phenomenon occurred, and there were produced the same clear images with high glossiness as obtained before the continuous copying operation.

Then, the image fixing apparatus No. 2 was disassembled to observe the surface of the image fixing roller and the oil application roller. There was no toner deposition.

Example 3

The image fixing apparatus No. 2 and the set of color toners C were incorporated in the copying machine.

The above-mentioned image formation test was carried out at an image fixing temperature of 150° C. The linear speed (A) was set at 140 mm/sec and the linear speed (B) was set at 90 mm/sec.

When the linear speed (A) was employed, the mean surface roughness (Rz) of the solid single color images fixed on every sheet was within the range of 9.6 to 10.5 μm. In this case, the solid single color images stably exhibited low glossiness in the range of 6 to 7. The image fixing properties were also excellent, and the color development properties of both the single color image and the mixed color image were all satisfactory.

When the linear speed (B) was employed, the mean surface roughness (Rz) of the solid single color images fixed on every sheet was within the range of 4.6 to 5.0 μm. In this case, the solid single color images stably exhibited high glossiness in the range of 28 to 30. The occurrence of the off-set phenomenon was not observed, and the color development properties of both the single color image and the mixed color image were all satisfactory.

Both in the case where the linear speed (A) and the linear speed (B) were employed, the dispersion in the mean surface roughness (Rz) was smaller than in Examples 1 and 2. This is because the surface properties of the toner compositions used in Example 3 were not so susceptible to the change of the applied thermal energy as those of the toner compositions employed in Examples 1 and 2, so that a great difference between the linear speed (A) and the linear speed (B) was compensated by the toner compositions.

Even when the image fixing temperature was increased by 55° C. in the mode of the linear speed (B), there occurred no off-set phenomenon. Namely, it was found that a good margin was left with respect to the occurrence of off-set phenomenon even when toner images were fixed at 150° C. at the linear speed (B).

The image fixing temperature was returned to 150° C. to make 10,000 copies. After making of 10,000 copies, no off-set phenomenon occurred, and there were produced the same clear images with high glossiness as obtained before the continuous copying operation.

Then, the image fixing apparatus No. 2 was disassembled to observe the surface of the image fixing roller and the oil application roller. There was no toner deposition.

Example 4

The image fixing apparatus No. 3 and the set of color toners C were incorporated in the copying machine.

The above-mentioned image formation test was carried out at an image fixing temperature of 130° C. The linear speed (A) was set at 180 mm/sec and the linear speed (B) was set at 80 mm/sec.

When the linear speed (A) was employed, the mean surface roughness (Rz) of the solid single color images fixed on every sheet was within the range of 15.6 to 16.0 μm. In this case, the solid single color images exhibited a low glossiness of 7±1. The glossiness of these images was remarkably stable. The image fixing properties were also excellent, and the color development properties of both the single color image and the mixed color image were all satisfactory.

When the linear speed (B) was employed, the mean surface roughness (Rz) of the solid single color images fixed on every sheet was within the range of 6.8 to 7.1 μm. In this case, the solid single color images exhibited a glossiness of 27±1. These images were remarkably stable images with intermediate glossiness. The occurrence of the off-set phenomenon was not observed, and the color development properties of both the single color image and the mixed color image were all satisfactory.

Both in the case where the linear speed (A) and the linear speed (B) were employed, there was scarcely observed any dispersion in the mean surface roughness (Rz). In particular, the mean surface roughness (Rz) of the fixed toner images on the first sheet immediately after the linear speeds were switched was stable. This is because the image fixing belt was used in the image fixing apparatus.

Even when the image fixing temperature was increased by 5° C. in the mode of the linear speed (B), there occurred no off-set phenomenon. Namely, it was found that a good margin was left with respect to the occurrence of off-set phenomenon even when toner images were fixed at 130° C. at the linear speed (B).

The image fixing temperature was returned to 130° C. to make 10,000 copies. After making of 10,000 copies, no off-set phenomenon occurred, and there were produced the same clear images with intermediate glossiness as obtained before the continuous copying operation.

Then, the image fixing apparatus No. 3 was disassembled to observe the surface of the image fixing belt and the oil application roller. There was no toner deposition.

Reference Example 1

The image fixing apparatus No. 3 and the set of color toners D were incorporated in the copying machine.

The above-mentioned image formation test was carried out at an image fixing temperature of 130° C. The linear speed (A) was set at 180 mm/sec and the linear speed (B) was set at 60 mm/sec.

When the linear speed (A) was employed, the mean surface roughness (Rz) of the solid single color images fixed on every sheet was within the range of 12.7 to 13.0 μm. In this case, the solid single color images exhibited a glossiness of 3±1. These images were remarkably stable images with no glossiness. The image fixing properties were also excellent, and the color development properties of both the single color image and the mixed color image were all satisfactory.

When the linear speed (B) was employed, the mean surface roughness (Rz) of the solid single color images fixed on every sheet was within the range of 10.3 to 10.6 μm. In this case, the solid single color images exhibited a glossiness of 15±1. These images were remarkably stable, but not regarded as the images with intermediate glossiness because the glossiness was too low.

Thereafter, the above-mentioned image formation test was repeated except that the image fixing temperature was changed from 130 to 140° C. at the linear speed (B).

When the linear speed (A) was employed, the mean surface roughness (Rz) of the solid single color images fixed on every sheet was within the range of 9.9 to 13.1 μm. In this case, the solid single color images exhibited a glossiness in the range of 3 to 6.

When the linear speed (B) was employed, the mean surface roughness (Rz) of the solid single color images fixed on every sheet was within the range of 6.8 to 7.9 μm. In this case, the solid single color images exhibited a glossiness in the range of 24 to 26. These images were stable images with intermediate glossiness. The occurrence of the off-set phenomenon was not observed, and the color development properties of both the single color image and the mixed color image were all satisfactory.

Although it was difficult to obtain the fixed toner images with intermediate glossiness merely by changing the linear speeds, the images with intermediate glossiness were obtained by increasing the image fixing temperature by 10° C. in the mode of the linear speed (B). In this case, the dispersion in the surface roughness and glossiness was more noticeable when compared with the case where the toner images with different glossinesses were fixed by changing the linear speeds at the same image fixing temperature. However, owing to the toner compositions D, the change in surface roughness of the toner image depending upon the applied thermal energy was small, so that the dispersion in the surface roughness was negligible.

Even when the image fixing temperature was increased by 5° C. in the mode of the linear speed (B), that is, increased to 145° C., there occurred no off-set phenomenon. Namely, it was found that a good margin was left with respect to the occurrence of off-set phenomenon even when toner images were fixed at 140° C. at the linear speed (B).

The image fixing temperature was returned to 140° C. to make 10,000 copies. After making of 10,000 copies, no off-set phenomenon occurred, and there were produced the same clear images with intermediate glossiness as obtained before the continuous copying operation.

Then, the image fixing apparatus No. 3 was disassembled to observe the surface of the image fixing belt and the oil application roller. There was no toner deposition.

Comparative Example 1

The image fixing apparatus No. 2 and the set of color toners B were incorporated in the copying machine.

The above-mentioned image formation test was carried out at the linear speed (A) of 140 mm/sec at an image fixing temperature of 155° C., and at the linear speed (B) of 140 mm/sec at an image fixing temperature of 170° C. Namely, the linear speeds (A) and (B) were equal.

When toner images were fixed at the linear speed (A) (140 mm/sec) at an image fixing temperature of 155° C., the mean surface roughness (Rz) of the solid single color images fixed on every sheet was within the range of 6.6 to 9.8 μm. In this case, the glossinesses of the solid single color images were in the range of 13 to 32, that is, not in the low glossiness range, but in the range from an intermediate level to a high level.

When image fixing was carried out at the linear speed (B) (140 mm/sec) at an image fixing temperature of 170° C., the mean surface roughness (Rz) of the solid single color images fixed on every sheet widely varied from 4.6 to 9.7 μm. However, in this case, the glossinesses of the solid single color images were included in the range of 39 to 43 with a narrow distribution. The occurrence of the off-set phenomenon was not observed, and the color development properties of both the single color image and the mixed color image were all satisfactory.

However, when the image fixing temperature was increased by 5° C. in the mode of the linear speed (B), there occurred the off-set phenomenon.

The wide distribution in the mean surface roughness in the mode of linear speed (A) was observed in the course of the second image fixing in the mode of linear speed (A) (140 mm/sec, 155° C.) after the completion of the first image fixing in the mode of linear speed (B) (140 mm/sec, 170° C.). Since the heat capacity of the image fixing roller was large, the second image fixing in the mode of linear speed (A) was started while the image fixing temperature was decreasing from 170 to 155° C.

In the image fixing by the mode of linear speed (A), the distribution of the glossiness was relatively narrow as compared with the distribution of the mean surface roughness, as mentioned above. The reason for this is that the distribution of the glossiness around the maximum glossiness is narrower than the distribution of the corresponding surface roughness. Under such image fixing conditions, the off-set phenomenon was considered to easily occur. In fact, the off-set phenomenon occurred when the image fixing temperature was increased by 5° C.

The image fixing temperature was returned to 170° C. to make 10,000 copies. After making of about 4,000 copies, the off-set phenomenon occurred in the halftone image portions. Some solid image portions caused the off-set phenomenon before completion of making of 10,000 copies.

Then, the image fixing apparatus No. 2 was disassembled to observe the surface of the image fixing roller and the oil application roller. There was observed toner deposition on the surface of the oil application roller.

Such image fixing conditions were susceptible to the off-set phenomenon. In addition, the toner compositions B showed a large change in the surface smoothness. Therefore, the slight off-set phenomenon easily occurred by small change in the image fixing conditions. The toner transferred to the image fixing roller was not returned to the sheet, but deposited on the surface of the oil application roller. The result was that the toner deposition hindered the application of oil onto the image fixing roller, and the release agent dispersed in the toner composition didn't work because of its insufficient amount.

Comparative Example 2

The image fixing apparatus No. 2 and the set of color toners A were incorporated in the copying machine.

The above-mentioned image formation test was carried out at an image fixing temperature of 155° C. The linear speed (A) was set at 140 mm/sec and the linear speed (B) was set at 100 mm/sec.

When the linear speed (A) was employed, the mean surface roughness (Rz) of the solid single color images fixed on every sheet was within the range of 9.6 to 11.6 μm. In this case, the solid single color images stably exhibited high glossiness in the same way as in Example 2.

When the linear speed (B) was employed, the mean surface roughness (Rz) of the solid single color images fixed on every sheet was within the range of 5.3 to 17.2 μm with a wide distribution. Likewise, the glossinesses of the solid single color images were widely ranging from 29 to 40.

The halftone image caused the off-set phenomenon in all ten sheets of paper on which the toner images were fixed at the linear speed (B). In addition, the off-set phenomenon was observed in the solid image portion in the eight sheets out of ten. The above-mentioned wide distribution of the mean surface roughness and glossiness resulted from the occurrence of the off-set phenomenon.

While the toner compositions B used in Example 2 contained the release agent, the toner compositions A used in Comparative Example 2 contained no release agent. The comparison between the evaluation results in Example 2 and Comparative Example 2 clarified the effect of the release agent for use in the toner composition.

Comparative Example 3

The image fixing apparatus No. 2 and the set of color toners E were incorporated in the copying machine.

The above-mentioned image formation test was carried out at an image fixing temperature of 160° C. The linear speed (A) was set at 150 mm/sec and the linear speed (B) was set at 75 mm/sec.

When the linear speed (A) was employed, the mean surface roughness (Rz) of the solid single color images fixed on every sheet was within the range of 9.7 to 10.9 μm. In this case, the solid single color images stably exhibited low glossiness in the range of 8 to 11. The image fixing properties were also excellent, and the color development properties of both the single color image and the mixed color image were all satisfactory.

When the linear speed (B) was employed, the mean surface roughness (Rz) of the solid single color images fixed on every sheet was within the range of 9.3 to 11.4 μm. These solid single color images stably exhibited high glossiness in the range of 32 to 34. Although the occurrence of the off-set phenomenon was not observed in the solid image portions, the halftone images caused the off-set phenomenon.

When the image fixing temperature was increased by 55° C. in the mode of the linear speed (B), the solid image portion also caused the off-set phenomenon. Namely, it was found that there was no margin between the image fixing temperature and the off-set occurrence temperature in the mode of the linear speed (B).

The image fixing temperature was returned to 160° C. to make continuous printing. After making of about 2,000 copies, some of the halftone image portion caused the off-set phenomenon. The solid image portion always caused the off-set phenomenon after making of about 4,000 copies, so that the continuous printing was stopped.

Then, the image fixing apparatus No. 2 was disassembled to observe the surface of the image fixing roller and the oil application roller. There was observed toner deposition on the surface of the oil application roller.

Even if the highly glossy toner images were fixed at the beginning of the continuous printing operation, such glossy toner images were not obtained after making of continuous printing. It was found that the margin between the image fixing temperature and the off-set occurrence temperature becomes narrow when there is a significant deviation in the mean surface roughness, or the mean surface roughness is high without a wide deviation.

TABLE 1

| | Release Agent in Toner (*) | Linear Speed (mm/sec) | | Image Fixing Temp. (° C.) | Mean Surface Roughness (Rz) of Fixed Toner Images | Glossiness of Fixed Toner Images | Image Fixing Properties at Speed A (**) | Off-set at Speed B (***) | Off-set at Speed B (+5° C.) (****) | Toner Deposition on Members in Image Fixing Apparatus (*****) Roller, Belt | Oil Applicator |
|---|---|---|---|---|---|---|---|---|---|---|---|
| Ex. 1 | — | A | 125 | 150 | 9.5 to 12.7 | 12 to 16 | ○ | ○ | ○ | ○ | ○ |
| | | B | 95 | 150 | 4.2 to 6.3 | 30 to 33 | | | | | |
| Ex. 2 | ○ | A | 140 | 155 | 9.5 to 11.9 | 8 to 12 | ○ | ○ | ○ | ○ | ○ |
| | | B | 100 | 155 | 4.1 to 5.5 | 39 to 44 | | | | | |
| Ex. 3 | ○ | A | 140 | 150 | 9.6 to 10.5 | 6 to 7 | ○ | ○ | ○ | ○ | ○ |
| | | B | 90 | 150 | 4.6 to 5.0 | 28 to 30 | | | | | |

TABLE 1-continued

| | Release Agent in Toner (*) | Linear Speed (mm/sec) | Image Fixing Temp. (° C.) | Mean Surface Roughness (Rz) of Fixed Toner Images | Glossiness of Fixed Toner Images | Image Fixing Properties at Speed A (**) | Off-set at Speed B (***) | Off-set at Speed B (+5° C.) (****) | Toner Deposition on Members in Image Fixing Apparatus (*****) Roller, Belt | Oil Applicator |
|---|---|---|---|---|---|---|---|---|---|---|
| Ex. 4 | ○ | A 180 | 130 | 15.6 to 16.0 | 7 ± 1 | ○ | ○ | ○ | ○ | ○ |
| | | B 80 | 130 | 6.8 to 7.1 | 27 ± 1 | | | | | |
| Ref. | ○ | A 180 | 130 | 12.7 to 13.0 | 3 ± 1 | ○ | ○ | not | not | not |
| Ex. 1 | | B 60 | 130 | 10.3 to 10.6 | 15 ± 1 | | | tested | tested | tested |
| | | A 180 | 130 | 9.9 to 13.1 | 3 to 6 | ○ | ○ | ○ | ○ | ○ |
| | | B 60 | 140 | 6.8 to 7.9 | 24 to 26 | | | | | |
| Comp. | ○ | A 140 | 155 | 6.6 to 9.8 | 13 to 32 | ○ | ○ | x | x | x |
| Ex. 1 | | B 140 | 170 | 4.6 to 9.7 | 39 to 43 | | | | | |
| Comp. | — | A 140 | 155 | 9.6 to 11.6 | 8 to 12 | ○ | x | x | not | not |
| Ex. 2 | | B 100 | 155 | 5.3 to 17.2 | 29 to 40 | | | | tested | tested |
| Comp. | ○ | A 150 | 160 | 9.7 to 10.9 | 8 to 11 | ○ | Δ | x | x | x |
| Ex. 3 | | B 75 | 160 | 9.3 to 11.4 | 32 to 34 | | | | | |

(*) Release agent in toner:
○ denotes that the release agent was dispersed in the toner.
— denotes that no release agent was contained in the toner.
(**) Image fixing properties at speed A:
○ denotes sufficient image fixing properties for full-color toner images.
x denotes insufficient image fixing properties for full-color toner images.
(***) Off-set at speed B:
○ denotes that no off-set phenomenon occurred in neither solid image portion nor halftone image portion.
Δ denotes that the halftone image portion caused the off-set phenomenon.
x denotes that the solid image portion caused the off-set phenomenon.
(****) Off-set at speed B (+5° C.):
○ denotes that no off-set phenomenon occurred in neither solid image portion nor halftone image portion.
Δ denotes that the halftone image portion caused the off-set phenomenon.
x denotes that the solid image portion caused the off-set phenomenon.
(*****) Toner deposition on members in image fixing apparatus:
○ denotes that the toner deposition was observed.
x denotes that no toner deposition was observed.

In the following Examples 5 to 8 and Comparative Examples 4 to 6, the image formation test was conducted in the following manner.

[Image Formation Test]

The two-component color developers were incorporated in a developer unit of a commercially available copying machine "PRETER 550" (Trademark), made by Ricoh Company, Ltd. The copying machine was modified so that the original image fixing apparatus was replaced by any image fixing apparatus as mentioned above. As the image receiving sheet, there was employed "type 6000-70W" with a surface roughness (Rz) of 29.9 μm, made by Ricoh Company, Ltd.

There were produced on the image receiving sheet a solid image and a halftone image, each consisting of a single color, that is, yellow, magenta, cyan, or black color, and a solid image of green, blue, or red color constituted by mixture of color toners. The copying machine was adjusted to produce a solid image of a single color with a toner deposition amount of 1.0±0.1 mg/cm$^2$, and a halftone image of a single color with a toner deposition amount of 0.4±0.1 mg/cm$^2$.

[Measurement of Surface Roughness]

The mean surface roughness (Rz) and the maximum height (Rmax) of the solid single color image was measured at the arbitrary measuring position.

The glossiness was measured by a gloss meter made by Nippon Denshoku Kogyo Co., Ltd. at an incident angle of 60° at the arbitrary measuring position.

The results are shown in TABLE 2.

[Off-set Occurrence Temperature]

The above-mentioned procedure for fixing the toner image on the sheet was repeated with the image fixing temperature of the image fixing belt being changed. Thus, the off-set occurrence temperature was determined. The results are shown in TABLE 2.

[Toner deposition on image fixing member]

After making of 10,000 copies, the image fixing apparatus was disassembled to observe whether the image fixing belt or oil application member was stained with toner deposition. The results are shown in TABLE 2.

Example 5

The image fixing apparatus No. 4 and the set of color toners F were incorporated in the copying machine.

The toner images were fixed at an image fixing temperature of 130° C.

The mean surface roughness (Rz) of the solid single color image was 7.6 μm, and the maximum height (Rmax) was 18.6 μm. This solid single color image showed a glossiness of as high as 22 without the off-set phenomenon. The color development properties of both the single color image and the mixed color image were all satisfactory.

The off-set occurrence temperature was 150° C. It was found that there was a good margin between the off-set occurrence temperature and the image fixing temperature.

The image fixing temperature was returned to 130° C. to make 10,000 copies. After making of 10,000 copies, no off-set phenomenon occurred, and there were produced the same clear images with high glossiness as obtained before the continuous copying operation.

Then, the image fixing apparatus No. 4 was disassembled to observe the surface of the image fixing belt and the oil application pad. There was no toner deposition.

Example 6

The image fixing apparatus No. 3 and the set of color toners F were incorporated in the copying machine.

The toner images were fixed at an image fixing temperature of 130° C.

The mean surface roughness (Rz) of the solid single color image was 4.6 μm, and the maximum height (Rmax) was 9.3 μm. When compared with Example 5, the decrease in surface roughness was considered to result from the increase in surface smoothness of the image fixing belt. This solid single color image showed a glossiness of as high as 35. The color development properties of both the single color image and the mixed color image were all satisfactory.

The off-set occurrence temperature was 170° C. It was found that the margin between the off-set occurrence temperature and the image fixing temperature was extended.

The image fixing temperature was returned to 130° C. to make 10,000 copies. After making of 10,000 copies, no off-set phenomenon occurred, and there were produced the same clear images with high glossiness as obtained before the continuous copying operation.

Then, the image fixing apparatus No. 3 was disassembled to observe the surface of the image fixing belt and the oil application roller. There was no toner deposition.

Example 7

The image fixing apparatus No. 5 and the set of color toners G were incorporated in the copying machine.

The toner images were fixed at an image fixing temperature of 130° C.

The mean surface roughness (Rz) of the solid single color image was 7.0 μm, and the maximum height (Rmax) was 13.3 μm. When compared with Example 6, the surface roughness was increased because the binder resin for use in the toner composition G showed a higher ½ flow-initiating point. The glossiness of this solid single color image was not so high as that in Example 6, but sufficient as a full-color image. The color development properties of both the single color image and the mixed color image were all satisfactory.

The off-set occurrence temperature was 185° C. It was found that the margin between the off-set occurrence temperature and the image fixing temperature was extended.

The image fixing temperature was returned to 130° C. to make 10,000 copies. After making of 10,000 copies, no off-set phenomenon occurred, and there were produced the same clear images with high glossiness as obtained before the continuous copying operation.

Then, the image fixing apparatus No. 5 was disassembled to observe the surface of the image fixing belt and the oil application roller. There was no toner deposition.

Example 8

The image fixing apparatus No. 5 and the set of color toners H were incorporated in the copying machine.

The toner images were fixed at an image fixing temperature of 130° C.

The mean surface roughness (Rz) of the solid single color image was 5.4 μm, and the maximum height (Rmax) was 11.4 μm. This solid single color image showed a glossiness of as high as 31 without the off-set phenomenon. The color development properties of both the single color image and the mixed color image were all satisfactory.

The off-set occurrence temperature was 180° C. It was found that there was a good margin between the off-set occurrence temperature and the image fixing temperature owing to the effect of the release agent dispersed in the toner composition.

The image fixing temperature was returned to 130° C. to make 10,000 copies. After making of 10,000 copies, no off-set phenomenon occurred, and there were produced the same clear images with high glossiness as obtained before the continuous copying operation.

Then, the image fixing apparatus No. 5 was disassembled to observe the surface of the image fixing belt and the oil application roller. There was no toner deposition.

Comparative Example 4

The image fixing apparatus No. 3 and the set of color toners I were incorporated in the copying machine.

The toner images were fixed at an image fixing temperature of 130° C.

The mean surface roughness (Rz) of the solid single color image was 13.3 μm, and the maximum height (Rmax) was 19.6 μm. This solid single color image showed a glossiness of as high as 25 without occurrence of the off-set phenomenon in the solid image portion. However, the halftone image portion caused the off-set phenomenon.

The off-set occurrence temperature was 140° C. Namely, the solid image portion caused the off-set phenomenon at the image fixing temperature of 140° C.

The image fixing temperature was returned to 130° C. to make 10,000 copies. After making of 10,000 copies, not only the halftone image portion, but also the solid image portion caused the off-set phenomenon.

Then, the image fixing apparatus No. 3 was disassembled to observe the surface of the image fixing belt and the oil application roller. There was observed toner deposition on the surface portion of the oil application roller in contact with the belt.

Comparative Example 5

The image fixing apparatus No. 3 and the set of color toners J were incorporated in the copying machine.

The toner images were fixed at an image fixing temperature of 130° C.

The mean surface roughness (Rz) of the solid single color image was 11.2 μm, and the maximum height (Rmax) was 17.8 μm. Although this solid single color image caused no off-set phenomenon, the glossiness was as low as 6, and the image was free from clearness as the full-color toner image.

The off-set occurrence temperature was 200° C.

The image fixing temperature was returned to 130° C. to make 10,000 copies. The presence or absence of the off-set phenomenon after making of 10,000 copies is shown in TABLE 2.

Then, the image fixing apparatus No. 3 was disassembled to observe the surface of the image fixing belt and the oil application roller. The presence or absence of the toner deposition on the image fixing members are shown in TABLE 2.

Comparative Example 6

The image fixing apparatus No. 5 and the set of color toners I were incorporated in the copying machine.

The toner images were fixed at an image fixing temperature of 130° C.

The mean surface roughness (Rz) of the solid single color image was 19.0 μm, and the maximum height (Rmax) was 22.6 μm. Not only the solid single color image portion, but also the halftone image portion caused off-set phenomenon, so that the glossiness of the fixed image was not measured.

The off-set occurrence temperature was 130° C. or less. Therefore, continuous printing was not carried out.

TABLE 2

| | Image Fixing Apparatus | Mean Surface Roughness (Rz) of Belt (μm) | Toner | Release Agent in Toner (*) | Fixed Image: Rz (μm) | Rmax (μm) | Glossiness | Off-set Phenomenon(**): Solid image portion | Off-set Phenomenon(**): Halftone image portion | Off-set Occurrence Temp. (° C.) | Toner Deposition on Members in Image Fixing Apparatus(***): Belt | Toner Deposition on Members in Image Fixing Apparatus(***): Oil Applicator |
|---|---|---|---|---|---|---|---|---|---|---|---|---|
| Ex. 5 | No. 4 | 6.0 | F | — | 7.6 | 18.6 | 22 | ○ | ○ | 150 | ○ | ○ |
| Ex. 6 | No. 3 | 4.1 | F | — | 4.6 | 9.3 | 35 | ○ | ○ | 170 | ○ | ○ |
| Ex. 7 | No. 5 | 4.1 | G | — | 7.0 | 13.3 | 20 | ○ | ○ | 185 | ○ | ○ |
| Ex. 8 | No. 5 | 4.1 | H | ○ | 5.4 | 11.4 | 31 | ○ | ○ | 180 | ○ | ○ |
| Comp. Ex. 4 | No. 3 | 4.1 | I | — | 13.3 | 19.6 | 25 | ○ | x | 140 | ○ | x |
| Comp. Ex. 5 | No. 3 | 4.1 | J | — | 11.2 | 17.8 | 6 | ○ | ○ | 200 | ○ | ○ |
| Comp. Ex. 6 | No. 5 | 4.1 | I | — | 19.0 | 22.6 | — | x | x | 130 or less | — | — |

(*) Release agent in toner:
○ denotes that the release agent was dispersed in the toner.
— denotes that no release agent was contained in the toner.
(**) Off-set phenomenon:
○ denotes that no off-set phenomenon occurred.
x denotes that the off-set phenomenon was observed.
(***) Toner deposition on members in image fixing apparatus:
○ denotes that the toner deposition was observed.
x denotes that no toner deposition was observed.

Japanese Patent Applications Nos. 11-327545 and 11-327546 filed Nov. 17, 1999 are hereby rated by reference.

What is claimed is:

1. A method for fixing full-color toner images on an image receiving member so that the toner images, after fixing, selectively exhibit different glossinesses, comprising the step of:

bringing toner images transferred to said image receiving member into contact with a heater with linear speeds being selectively switched in such a manner that the toner images, after fixing, exhibit a mean surface roughness in a range of 9.5 to 16 μm when fixed at a linear speed (A) at an image fixing temperature (T), and exhibit a mean surface roughness of less than 8 μm when fixed at a linear speed (B) at an image fixing temperature (T'), wherein said linear speed (A) is in a range of 100 to 300 mm/sec, said linear speed (B) is lower than said linear speed (A) by 25 mm/sec or more, and said image fixing temperatures (T) and (T') are equal.

2. The full-color toner image fixing method as claimed in claim 1, wherein said linear speed (B) is in a range of ⅓ to ⅔ said linear speed (A).

3. The full-color toner image fixing method as claimed in claim 1, wherein said heater is in the form of a belt.

4. The full-color toner image fixing method as claimed in claim 1, wherein the toner images are produced using a full-color toner which comprises a coloring agent, a resin, and a release agent which is dispersed in said resin.

5. A method for fixing full-color toner images on an image receiving member so that the toner images, after fixing, selectively exhibit different glossinesses, comprising the step of:

bringing toner images transferred to said image receiving member into contact with a heater in the form of a belt with linear speeds being selectively switched in such a manner that the toner images, after fixing, exhibit a mean surface roughness in a range of 9.5 to 16 μm when fixed at a linear speed (A) at an image fixing temperature (T), and exhibit a mean surface roughness of less than 8 μm when fixed at a linear speed (B) at an image fixing temperature (T'), wherein said linear speed (A) is in a range of 100 to 300 mm/sec, said linear speed (B) is lower than said linear speed (A) by 25 mm/sec or more, and wherein said image fixing temperatures (T) and (T') are in a relationship of $T<T' \leqq T+10°$ C., and said linear speeds A and B are in a relationship of $\frac{1}{3}A \leqq B \leqq \frac{2}{3}A$.

6. A method for fixing full-color toner images with high glossiness on an image receiving member, comprising the step of:

bringing toner images transferred to said image receiving member into contact with an image fixing belt so that said toner images, after fixing, exhibit a mean surface roughness of less than 8 μm.

7. The full-color toner image fixing method as claimed in claim 6, wherein said mean surface roughness of said toner images, after fixing, is different from a maximum height by less than 10 μm.

8. The full-color toner image fixing method as claimed in claim 6, wherein said belt has a surface portion with a mean surface roughness of 5 μm or less in contact with said full-color toner images.

9. The full-color toner image fixing method as claimed in claim 6, wherein the toner images are produced using a full-color toner which comprises a coloring agent, a resin, and a release agent which is dispersed in said resin.

10. An apparatus for fixing full-color toner images on an image receiving member so that the toner images, after fixing, selectively exhibit different glossinesses, comprising:

a heater for heating toner images transferred to said image receiving member in such a configuration that said heater is brought into contact with said toner images, with linear speeds being selectively switched in such a manner that the toner images, after fixing, exhibit a mean surface roughness in a range of 9.5 to 16 μm when fixed at a linear speed (A) at an image fixing temperature (T), and exhibit a mean surface roughness of less than 8 μm when fixed at a linear speed (B) at an image fixing temperature (T'), wherein said linear speed (A) is in a range of 100 to 300 mm/sec, said linear speed (B) is lower than said linear speed (A) by 25 mm/sec or more, and said image fixing temperatures (T) and (T') are equal.

11. The apparatus as claimed in claim 10, wherein said linear speed (B) is in a range of ⅓ to ⅔ said linear speed (A).

12. The apparatus as claimed in claim 10, wherein said heater is in the form of a belt.

13. The apparatus as claimed in claim 10, wherein the toner images are produced using a full-color toner which comprises a coloring agent, a resin, and a release agent which is dispersed in said resin.

14. An apparatus for fixing full-color toner images on an image receiving member so that the toner images, after fixing, selectively exhibit different glossinesses, comprising:

a heater in the form of a belt for heating toner images transferred to said image receiving member in such a configuration that said heater is brought into contact with said toner images, with linear speeds being selectively switched in such a manner that the toner images, after fixing, exhibit a mean surface roughness in a range of 9.5 to 16 μm when fixed at a linear speed (A) at an image fixing temperature (T), and exhibit a mean surface roughness of less than 8 μm when fixed at a linear speed (B) at an image fixing temperature (T'), wherein said linear speed (A) is in a range of 100 to 300 mm/sec, said linear speed (B) is lower than said linear speed (A) by 25 mm/sec or more, and wherein said image fixing temperatures (T) and (T') are in a relationship of $T<T'\leqq T+10°$ C., and said linear speeds A and B are in a relationship of $\frac{1}{3}A\leqq B\leqq\frac{2}{3}A$.

15. An apparatus for fixing full-color toner images with high glossiness on an image receiving member, comprising:

an image fixing belt for heating toner images so that said toner images, after fixing, exhibit a mean surface roughness of less than 8 μm by bringing said belt into contact with toner images transferred to said image receiving member.

16. The apparatus as claimed in claim 15, wherein said mean surface roughness of said toner images, after fixing, is different from a maximum height by less than 10 μm.

17. The apparatus as claimed in claim 15, wherein said belt has a surface portion with a mean surface roughness of 5 μm or less in contact with said full-color toner images.

18. The apparatus as claimed in claim 15, wherein the toner images are produced using a full-color toner which comprises a coloring agent, a resin, and a release agent which is dispersed in said resin.

* * * * *